US005619756A

United States Patent [19]

Garneau

[11] Patent Number: 5,619,756

[45] Date of Patent: Apr. 15, 1997

[54] CYCLIST HELMET WITH MULTIPLE APERTURES RIM

[75] Inventor: Louis Garneau, Augustin-de-Desmaures, Canada

[73] Assignee: 9001 6262 Québec Inc., St-Augustin-de-Desmaures, Canada

[21] Appl. No.: 625,492

[22] Filed: Mar. 29, 1996

[51] Int. Cl.[6] ..... A42B 1/06

[52] U.S. Cl. ..... 2/425; 2/411

[58] Field of Search ..... 2/410, 411, 425, 2/421, 412, 414, 422, 171.3; 264/241, 250, 255

[56] References Cited

U.S. PATENT DOCUMENTS 5,119,516 6/1992 Broersma ..... 2/411
5,271,103 12/1993 Darnell ..... 2/425
5,351,342 10/1994 Garneau ..... 2/425
5,450,631 9/1995 Egger ..... 2/425
5,477,563 12/1995 Gentes et al. ..... 2/411

*Primary Examiner*—Michael A. Neas
*Attorney, Agent, or Firm*—François Martineau

[57] ABSTRACT

The helmet includes a shell, made of polystyrene, and a rim, made of polypropylene and integrally connected to the shell. Both the shell and the rim have air ventilation apertures. Chin straps integrally depend from the internal face of the shell. The shell and the rim are interconnected by cross-sectionally L-shape fingers, integral to the rim, and complementary cavities, made in the shell peripheral edge and engaged by the fingers. The rim apertures are obliquely inclined at the lateral sides thereof, to promote air ventilation around the wearer's head. A set of arcuate metallic wires, embedded into the helmet and preferably made of titanium, may also integrally interconnect the shell to the rim.

9 Claims, 4 Drawing Sheets

CYCLIST HELMET WITH MULTIPLE APERTURES RIM

FIELD OF THE INVENTION

This invention relates to lightweight plastic helmets that are attached by straps to the head of cyclists and the like for protecting the head against injuries from accidental falls.

BACKGROUND OF THE INVENTION

Cyclists pedalling on their bicycle will perspirate and thus need good ventilation beneath their helmet if they wish to be comfortable. It is known to provide air ventilation apertures in the upper shell part of the helmet; however, due to constraints related to the required choice of material for the lower rim part of the helmet, it was not possible in the past to provide air ventilation apertures in this rim part.

OBJECTS OF THE INVENTION

The gist of the invention is therefore to further enhance air ventilation behind the helmet of cyclists when they are in motion, by providing apertures along the rim part of the helmet.

A corollary object of the invention is to provide a method of manufacture of a plastic-based cyclist helmet, made from separate shell and rim parts, in which the shell and rim interlocking will be enhanced by the plastic material shrinkage following molding.

SUMMARY OF THE INVENTION

Accordingly with the object of the invention, there is disclosed a helmet including a shell, made of polystyrene, and a rim, made of polypropylene and integrally connected to the shell. Both the shell and the rim have air ventilation apertures. Chin straps integrally depend from the inner face of the shell. The shell and the rim are interconnected by cross-sectionally L-shape fingers, integral to the rim, and complementary cavities made in the shell peripheral edge and engaged by the fingers. The rim apertures are obliquely inclined at the lateral sides thereof, to promote air ventilation. A set of arcuate metallic wires, embedded into the helmet and preferably made of titanium, may also integrally interconnect the shell to the rim.

More generally, there is disclosed a protective helmet for use on a cyclist's head, comprising an upper rigid convex shell part, a lower semi-rigid resilient annular rim part, and interlocking means to interlock said shell and rim parts, said rim part having first air ventilation apertures at its periphery, said shell part adapted to be attached to the person's head by chin straps; wherein a circular air ventilation path beneath said shell part is achieved under dynamic cycling conditions.

The invention also relates to a method of manufacture of such a protective helmet consisting of a shell part and of a rim part both made from plastic material, comprising the following steps: (a) molding said rim part with a number of cross-sectionally L-shape fingers integrally projecting from said rim part with the transverse leg of the fingers being directed radially inwardly of the rim and with first air ventilation apertures mounted at its periphery; (b) leaving the molded rim part to cure; (c) engaging four inserts on the front, rear and lateral sides of said rim part; (d) molding said shell part with a number of edgewise cavities made at the periphery of said shell and shaped complementarily to said fingers, wherein each said fingers are frictionally engaged into corresponding said cavities, with said shell part adapted to be attached to the person's head by chin straps, wherein a circular air ventilation path beneath said shell part is achieved under dynamic cycling conditions; and (e) allowing the plastic material from said shell part to shrink against said rim part, wherein enhanced interlocking action occurs between the interengaged said fingers and corresponding said cavities as the fingers are forcibly drawn into the respective cavities due to the plastic shrinkage.

DETAILED DESCRIPTION OF THE EMBODIMENTS OF THE INVENTION

Figure 1:
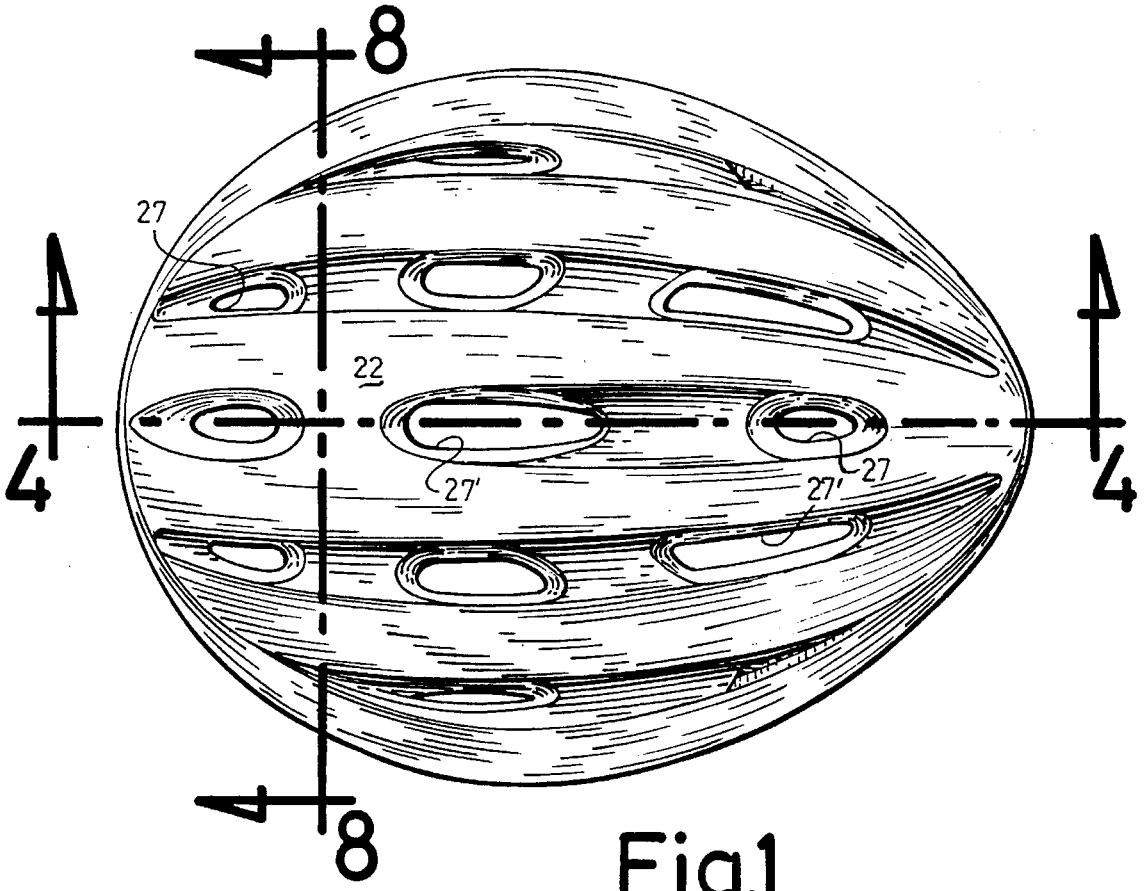
FIG. 1 is a top plan view of a preferred embodiment of cyclist helmet according to the invention, showing the air ventilation apertures of the shell part thereof.
Figure 2:
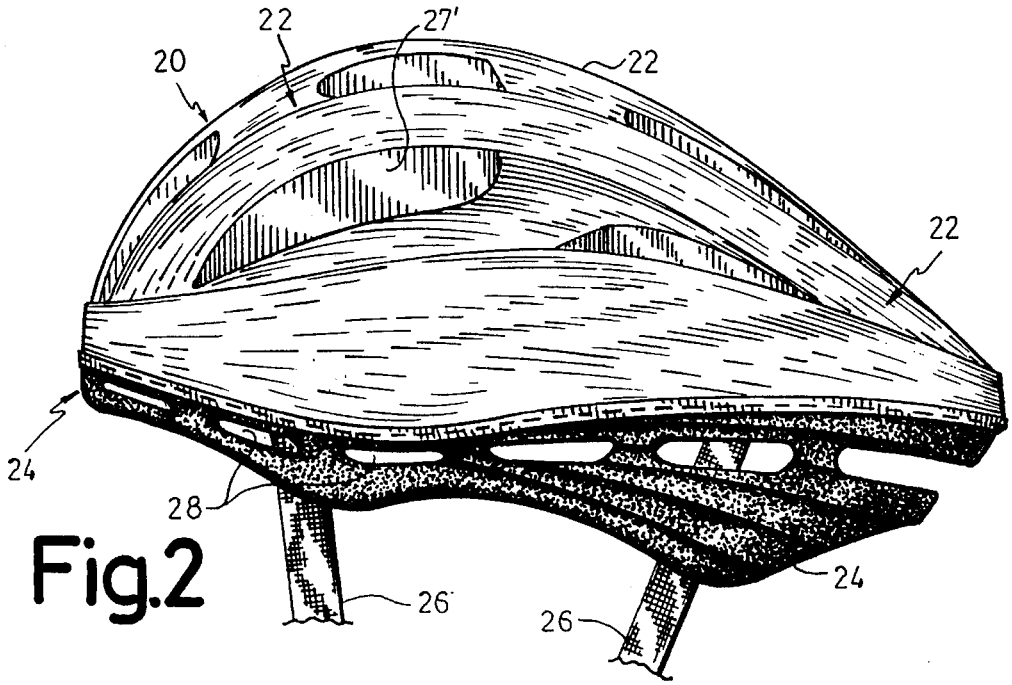
FIG. 2 is a side elevational view of the helmet, showing chin straps and the air ventilation apertures of the rim part thereof.
Figure 8:
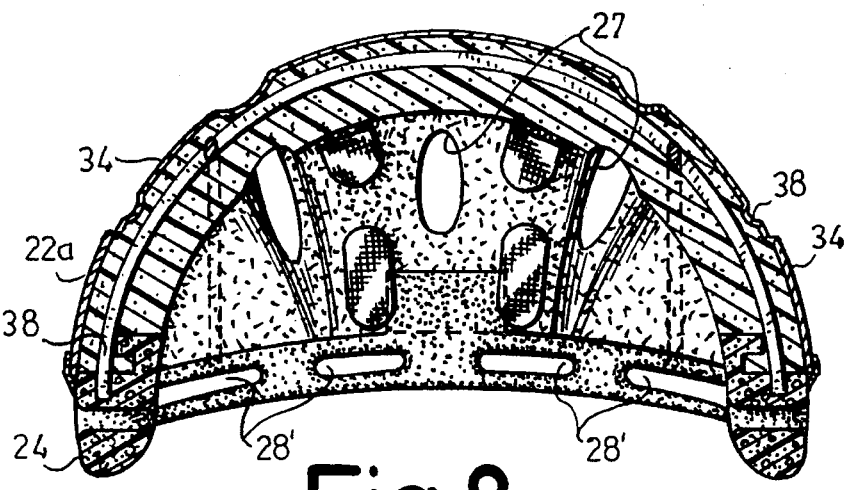
FIG. 8 is a cross-sectional view of the helmet taken along line 8—8 of FIG. 1, and further showing reinforcing titanium wires being embedded into the shell and rim parts.

The protective helmet 20 of FIGS. 1–2 is made of two separate parts: a generally convex shell 22, and an annular rim 24. Chin straps 26 are connected to the internal wall **22*a* (FIG. 8) of the shell 22, for attachment of the helmet to the head of a person. The shape of the outer wall 22*b* of shell 22 is generally convex, not excluding aerodynamically contoured as illustrated i.e. being wing-like in lateral edge view (see FIG. 2**). Both the shell and the rim parts should be made from a rigid lightweight material, although the rim should be softer and somewhat resilient.

Preferably, the shell 22 is made from rigid polystyrene, while the rim 24 is made from softer, resilient (shock-absorbing) polypropylene. The selected rim material will not crumble, it will provide a shock-absorbing effect, and will be molded independently of the shell part as will be seen later.

The shell 22 includes a number of air ventilation apertures 27, at least some of these apertures, 27', being preferably elongated in a fore and aft direction. Apertures 27, 27' have a wider mouth at their outer ends (in register with the shell outer wall 22*b*) than at their inner ends (in register with the shell interior wall 22*a*), thus forming funnel-shape air channels therethrough, enhancing air ventilation beneath the helmet shell; this also reinforces the helmet structural rigidity.

Figure 4:
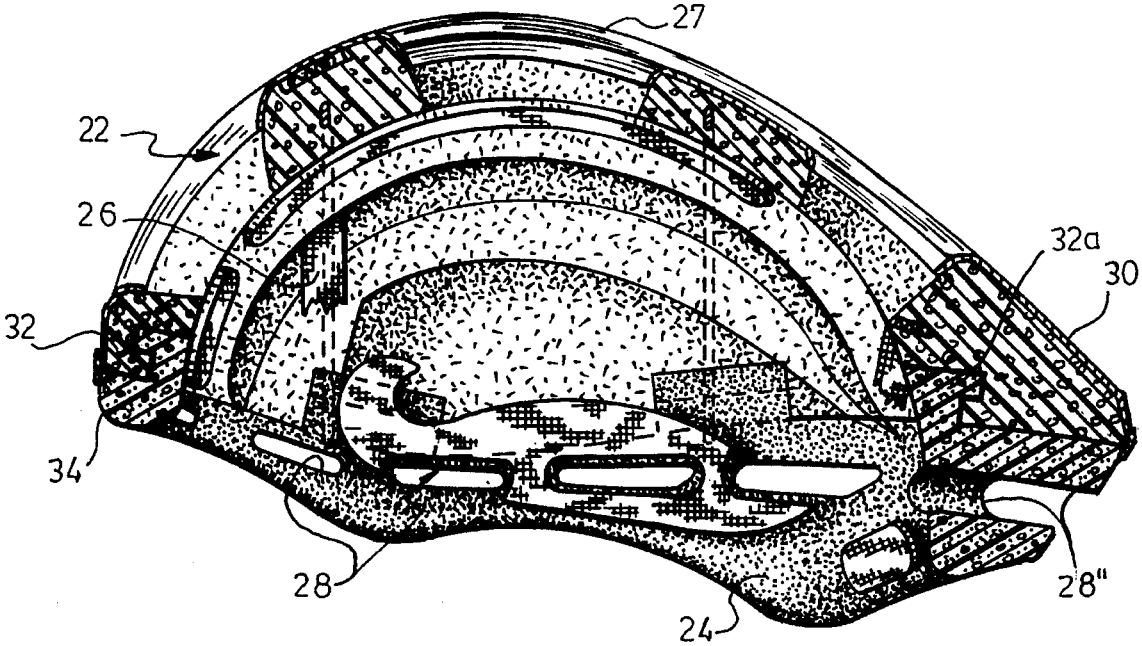
FIG. 4 is a sectional view of the helmet, taken along line 4—4 of FIG. 1.

The annular rim 24 also includes a number, preferably about twelve, of air ventilation apertures 28 along its periphery. Preferably, these apertures 28 are ovoidal, as shown. As suggested in FIG. 8, the apertures 28' located at the front end of the rim 24 should be smaller than the apertures 28" (FIG. 4) at the rear end of the rim part. The rim apertures 28 should have a height not exceeding one third that of the height of the rim body 24, so as not to compromise structural rigidity of the helmet.

Figure 5:
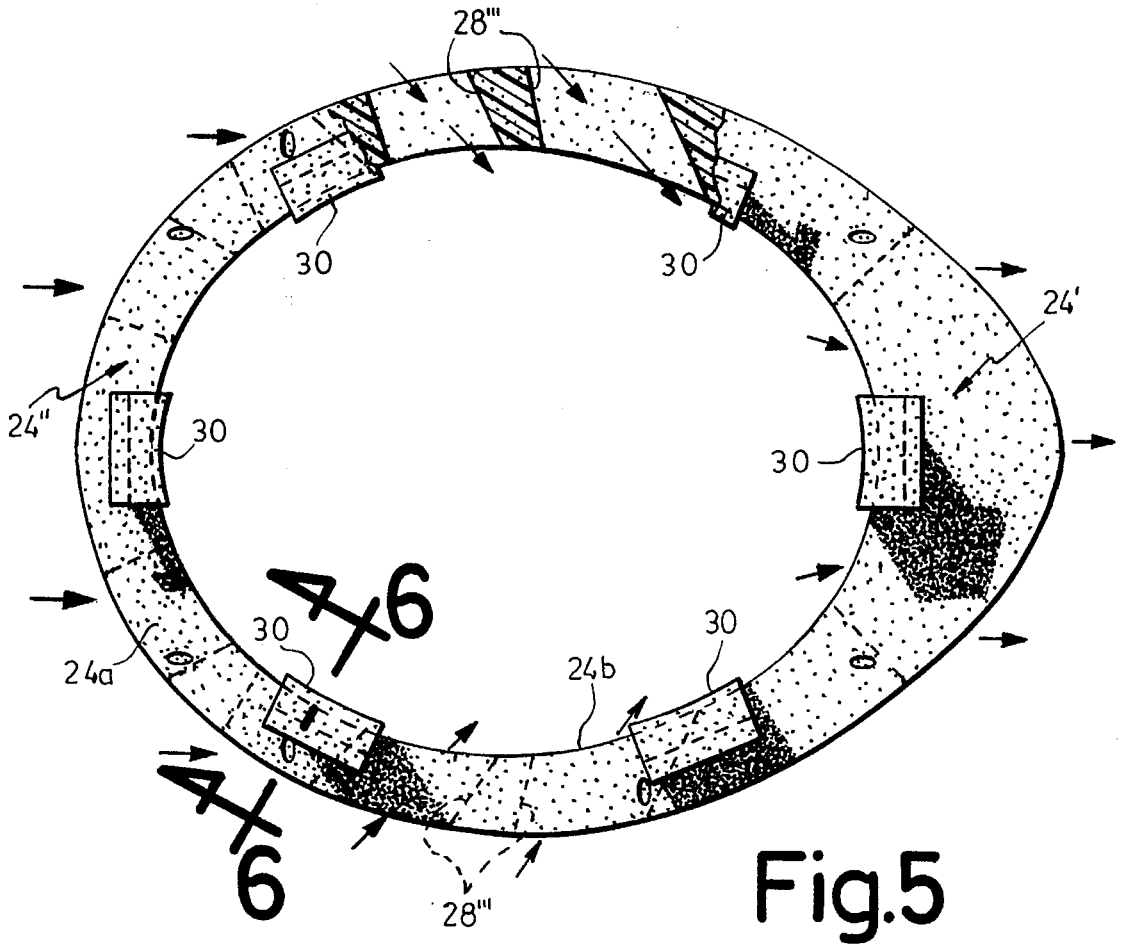
FIG. 5 is a top plan view of the detached helmet rim part, showing the six integral anchor fingers thereof, and also showing in fragmentary view the oblique lateral air ventilation apertures of the rim part.

As also suggested in FIG. 5, the apertures 28'" on the lateral sides of the rim 24 are preferably obliquely inclined in a rearwardly interior direction, again to promote enhanced air ventilation along a circular path beneath the helmet shell, by generating a turbulence effect.

Figure 7:
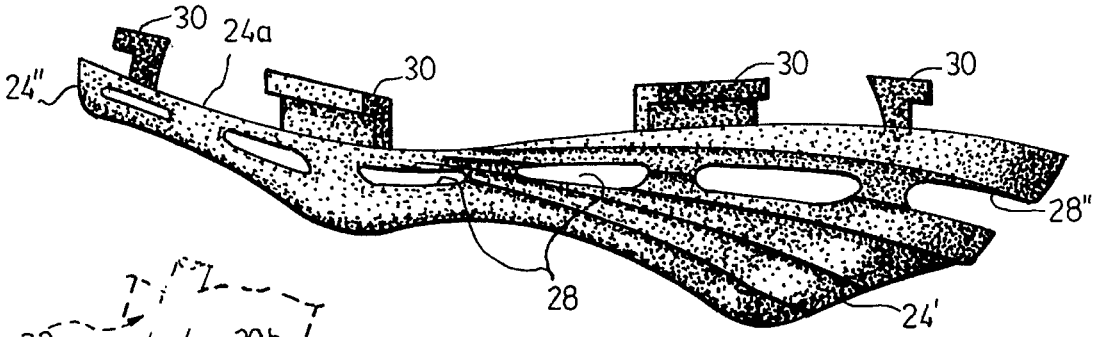
FIG. 7 is an edge view of the detached helmet rim, showing a number of anchor fingers.

As illustrated in FIG. 7, the rim 24 tapers in height from a thick rear portion 24' to a thin front portion 24"; and as illustrated in FIG. 5, the rim is wider at its rear portion 24' than at its front portion 24". Such dimensions are in line with ergonomic considerations.

Figure 6:
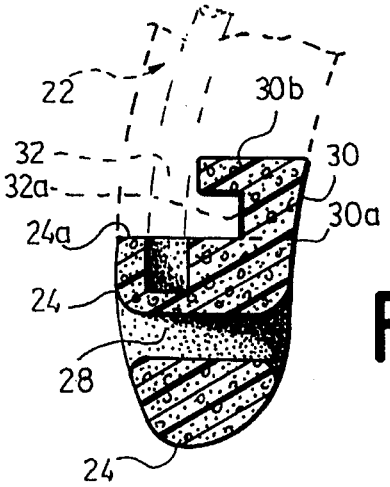
FIG. 6 is a cross-sectional view of the rim part, showing an enlarged cross-sectional view of an anchor finger, taken along line 6—6 of FIG. 5, and suggesting how the helmet shell edgewise portion—shown in phantom lines—can edgewisely fit against the helmet rim and an associated anchor finger.

Because the shell 22 is made from rigid polystyrene, while the rim 24 is made from softer, resilient polypropylene, special interlocking means are required, since these two plastic materials, and particularly polypropylene which does not stick to glue compounds, cannot easily be interconnected by conventional glue compounds or the like. Accordingly, the rim part 24 is made to include a certain number, e.g. six in FIG. 5, or more, cross-sectionally L-shape integral extension blocks or fingers 30, integrally depending from the top wall 24*a* of the rim tangentially to the rim radially internal edge. The straight fingers 30 are spaced from one another and should preferably be equidistant with respect to the successive pairs of fingers. Each finger 30 is of a small length relative to the peripheral edge of the rim 24, representing a small fraction thereof to be for example of a length of about 5 cm. Each finger 30 (FIGS. 6–7) includes an upright leg 30*a*, adjacent the radially interior wall 24*b* of rim 24, and a radially outturned leg 30*b*, overhanging a fraction of the top wall 24*a* of rim 24.

The convex shell 22 further includes along its peripheral edge 32 a corresponding number of spaced cavities 32*a*, each cavity being of a shape complementary to that of a corresponding finger 30.

The fact that the protective helmet 20 is made from two separate parts, namely, a convex shell 22, and an annular rim 24, facilitates the molding operation. The process of manufacture of the helmet 20 is as follows. First, it is noted that all plastic materials shrink after molding, due to a known chemical reaction in ambiant air. The rim 24 and the shell 22 are molded separately. First, the annular polypropylene rim 24 is molded, with its integral fingers 30 in overhanging condition; a 24-hour curing period is to be expected. Then the polystyrene convex shell 22 is molded over the shaped rim 24 by using four inserts, to bring the L-shape fingers 30 of the rim freely inside the complementary cavities 32*a* of the shell 22. Then, the molded shell 22 and rim 24 are left to cure for a period of about thirty days corresponding to the curing period of the polystyrene shell 22, wherein plastic shrinkage will occur to interlock the shell 22 and rim 24 by frictionally biasing the fingers 30 still further inside the cavities 32*a*.

Polypropylene is the choice material for the rim 24, because it provides high resistance to impact blows, is more rubbery and thus comfortable for the wearer, and facilitates manufacture of air ventilation apertures.

The polystyrene shell may be covered by a plastic lining 34 (FIG. 8), e.g. made from ABS, polycarbonate, or polyethylene. This plastic lining 34 may be coloured with a specific design layout, so as to provide aesthetic features to the helmet 20, and will also provide resistance against chipping or other damage to the surface of the helmet.

Figure 3:
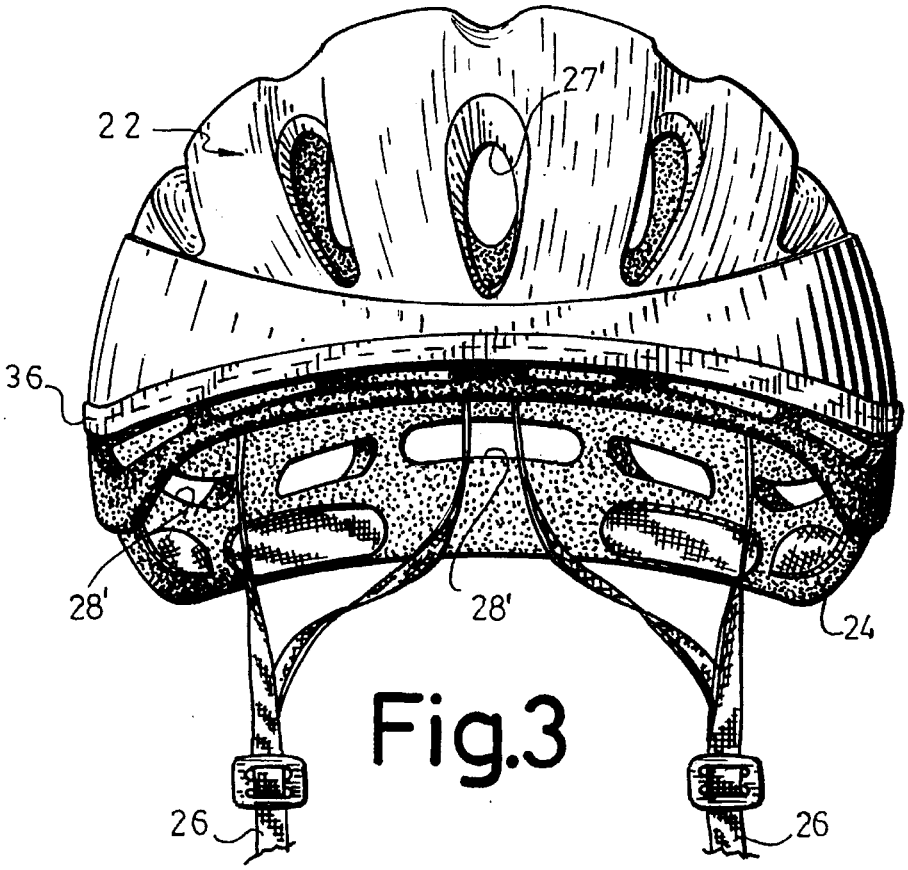
FIG. 3 is a front elevational view of the helmet, showing the air ventilation apertures of both the shell part and rim part.

As illustrated in FIG. 3, the convex shell 22, with or without its polycarbonate lining, defines an annular gap with the laterally outer wall of the annular rim 24. This annular gap can be closed by a flexible sealing strip 36, for aesthetic purposes.

Figure 9:
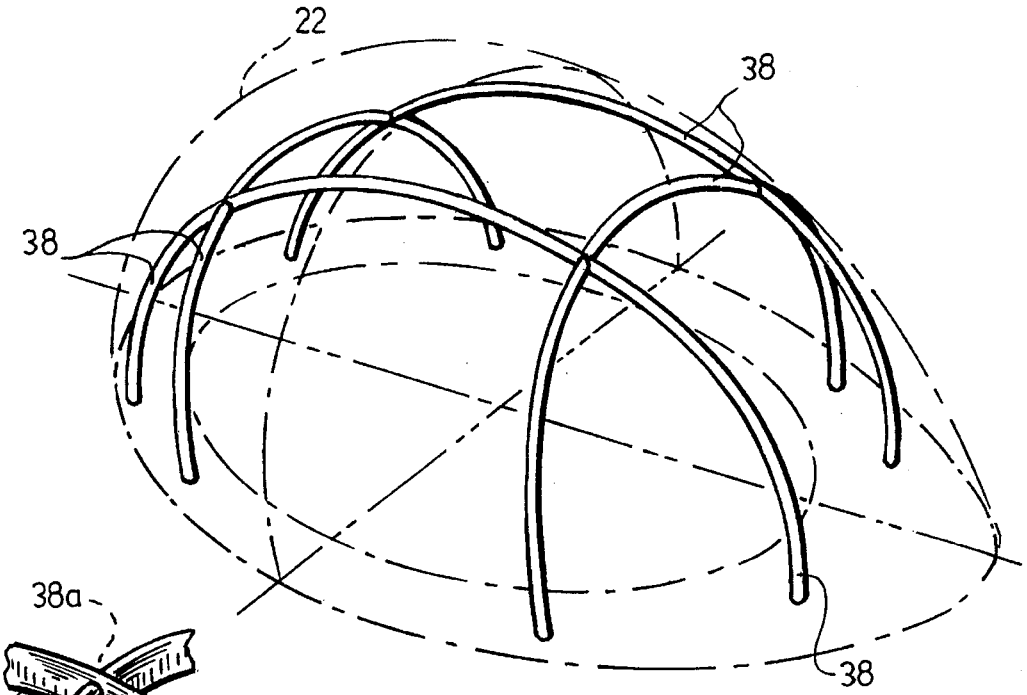
FIG. 9 is a schematic isometric view of the helmet outline in phantom lines, showing in full lines the network of reinforcing titanium wires in their operative embedded condition inside the shell and rim parts of the helmet.
Figure 10:
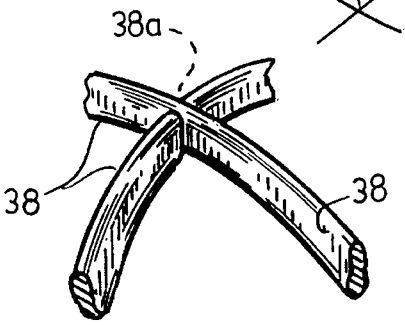
FIG. 10 is an enlarged fragmentary view of the intersection of two titanium wires from the wire network of FIG. 9.
Figure 11:
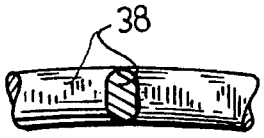
FIG. 11 is a cross-sectional view of a titanium wire from the assembly of FIG. 10.

In an alternate embodiment of the invention, illustrated in FIGS. 8–11 of the drawings, a set of arcuate rigid metallic wires 38, preferably made of titanium alloy, may also integrally interconnect the shell 22 to the rim 24. Wires 38 are rigid and preferably of oblong shape in cross-section, as illustrated in FIG. 11. As shown in FIGS. 9–10, the wires 38 overlap one another in pairs at intersecting areas, with one wire from each pair of wires 38 having a complementary notch 38*a* to receive and support the registering body section of the other one wire from the same pair.

With the present helmet selected air ventilation apertures both at the shell part 22 and at the rim part 24, a "circular" air ventilation pathway is achieved inside the helmet and around the head, contrary to prior art air ventilation helmet systems air ventilation inside the helmet was limited to "linear" (i.e. fore and aft) air circulation through the helmet.

The embodiments of the invention for which an exclusive property or privilege is claimed, are defined as follows:

I claim:

1. A protective helmet for use on a cyclist's head, comprising an upper rigid generally convex shell part, a lower semi-rigid resilient annular rim part, and interlocking means to interlock said shell and rim parts, said rim part having a number of first air ventilation apertures distributed at its periphery, said shell part adapted to be attached to the person's head by chin straps;

wherein a circular air ventilation path beneath said shell part is achieved under dynamic cycling conditions;

said shell part further having a number of spaced second air ventilation apertures;

wherein said helmet shell is made from polystyrene, and said rim part is made from polypropylene.

2. A protective helmet as defined in claim 1, wherein said helmet defines a front and a rear end and a pair of opposite lateral sides, said rim part air ventilation apertures being obliquely inclined interiorly and rearwardly along said lateral sides of the helmet, to further enhance circular air ventilation beneath the helmet shell.

3. A protective helmet as defined in claim 2, wherein said rim part apertures include frontwardly and rearwardly located apertures, said frontwardly located apertures being generally ovoidal and smaller than said rearwardly located apertures.

4. A protective helmet as defined in claim 1, wherein said interlocking means consists of a number of cross-sectionally L-shape fingers, integrally projecting from said rim with the transverse leg of the fingers being directed radially inwardly of the rim, and a number of edgewise cavities, made at the periphery of said shell and shaped complementarily to said fingers, wherein each said finger is frictionally engaged into a corresponding said cavity.

5. A protective helmet as defined in claim 1, further including a protective lining, fixedly applied against the outer wall of said convex shell, said protective lining being from a material selected from the group comprising ABS, polycarbonate, and polyethylene.

6. A protective helmet as defined in claim 1, wherein said interlocking means consists of a number of arcuate titanium alloy wires, being embedded into and straddling the shell and rim parts.

7. A method of manufacture of a protective helmet consisting of a shell part and of a rim part with said helmet shell made from polystyrene and with said rim part made from polypropylene, the method comprising the following steps:

(a) molding said rim part with a number of cross-sectionally L-shape fingers integrally projecting from said rim part with the transverse leg of the fingers being directed radially inwardly of the rim and with first air ventilation apertures mounted at the rim periphery;

(b) leaving the molded rim part to cure;

(c) engaging four inserts on the front, rear and lateral sides of said rim part;

(d) molding said shell part against said rim part with a number of edgewise cavities made at the periphery of said shell part and shaped complementarily to said fingers, wherein each said finger is frictionally engaged into a corresponding said cavity; and (e) allowing the plastic material from said shell part to cure and to shrink against said rim part, wherein enhanced interlocking action occurs between the interengaged said fingers and corresponding cavities as the fingers are forcibly drawn into the respective cavities due to the plastic shrinkage.

8. A method of manufacture of a protective helmet as in claim 7, further including the additional step of embedding arcuate titanium wires in the body of the shell and rim parts to straddle both shell and rim parts, to further forcibly interconnect same, said additional step occurring between steps (a) and (b).

9. A protective helmet for use on a cyclist's head, comprising an upper rigid generally convex shell part, a lower semi-rigid resilient annular rim part, and interlocking means to interlock said shell and rim parts, said annular rim part forming a continuous ring adapted to fit and completely surround the sides of the cyclist's head, said rim part having a number of first air ventilation apertures distributed at selected intervals all around its periphery including front and rear first apertures, said first air ventilation apertures being fully contained by said annular rim part and being non-hemi-elliptical, said shell part adapted to be attached to the person's head by chin straps;

wherein a generally toroidal air ventilation path beneath said shell part and between said rim part and the cyclist's head is achieved under dynamic cycling conditions for cooling the head, said toroidal air ventilation path extending within a plane generally orthogonal to the sagittal plane of the cyclist, said shell part further having a number of spaced longitudinal second air ventilation apertures.

* * * * *